United States Patent [19]

Albrecht

[11] Patent Number: 4,905,550

[45] Date of Patent: Mar. 6, 1990

[54] ATTACHMENT FOR WRENCH JAWS

[75] Inventor: Robert F. Albrecht, Rock Island, Ill.

[73] Assignee: Robert F. Albrecht, Inc., Rock Island, Ill.

[21] Appl. No.: 333,926

[22] Filed: Apr. 4, 1989

Related U.S. Application Data

[63] Continuation of Ser. No. 152,520, Feb. 5, 1988, abandoned.

[51] Int. Cl.[4] ..... B25B 13/58

[52] U.S. Cl. ..... 81/185.1; 81/423

[58] Field of Search ..... 81/185.1, 186, 421, 81/422, 423

[56] References Cited

U.S. PATENT DOCUMENTS

| | | | |
|---|---|---|---|
| 911,924 | 2/1909 | Vader | 81/185.1 |
| 1,706,427 | 3/1929 | Wachsmuth | 81/185.1 |
| 2,725,774 | 12/1955 | Tekse | 81/423 |
| 3,083,599 | 4/1963 | Slagle | 81/185.1 |

OTHER PUBLICATIONS

America Machinist, p. 89, May 11, 1944.

*Primary Examiner*—Frederick R. Schmidt
*Assistant Examiner*—Blynn Shideler
*Attorney, Agent, or Firm*—Henderson & Sturm

[57] ABSTRACT

The utility of attachments for wrench jaws which provide gripping surfaces which will not injure highly polished surfaces to which the wrench is gripped. An attachment for wrench jaws is disclosed wherein the attachment comprises a unitary piece capable of being received over a plurality of wrench jaws and wherein the surface to be applied to the surface to be rotated by the wrench is serrated in the same fashion as the jaws of the wrench. The unitary piece further being held in position by the serrations of the wrench itself being applied against the inner surface of the attachment piece.

4 Claims, 2 Drawing Sheets

Fig. 1
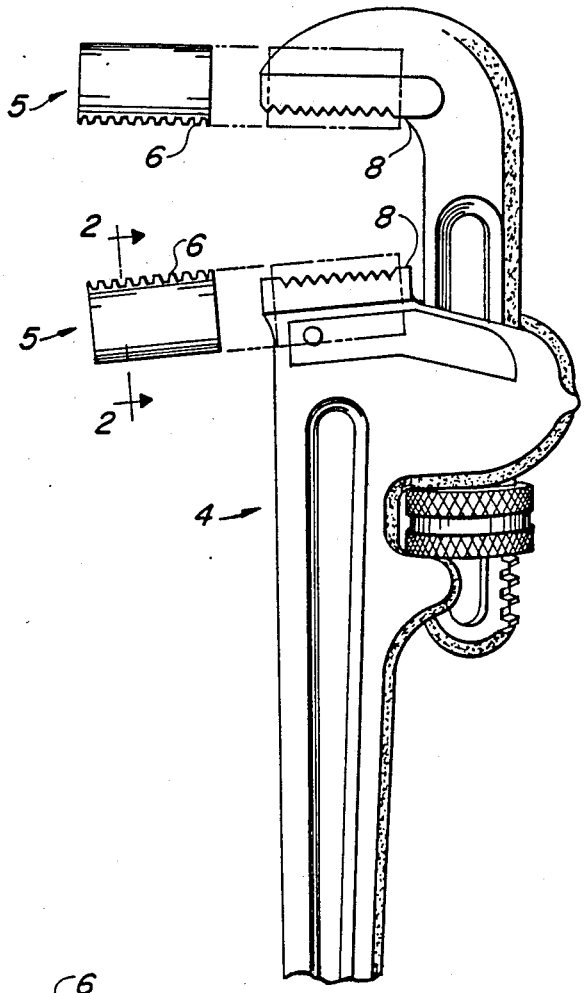
Fig. 2
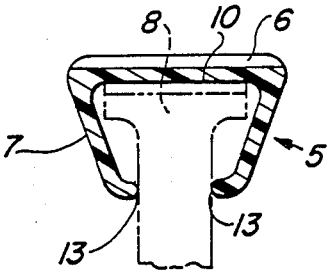
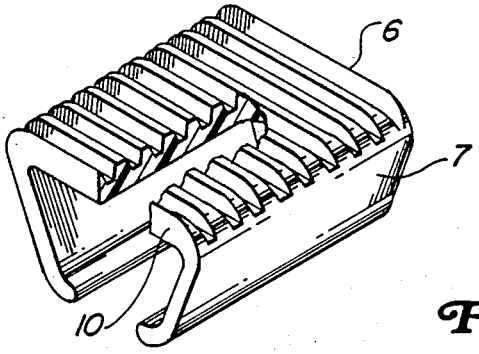
Fig. 3

Fig. 4
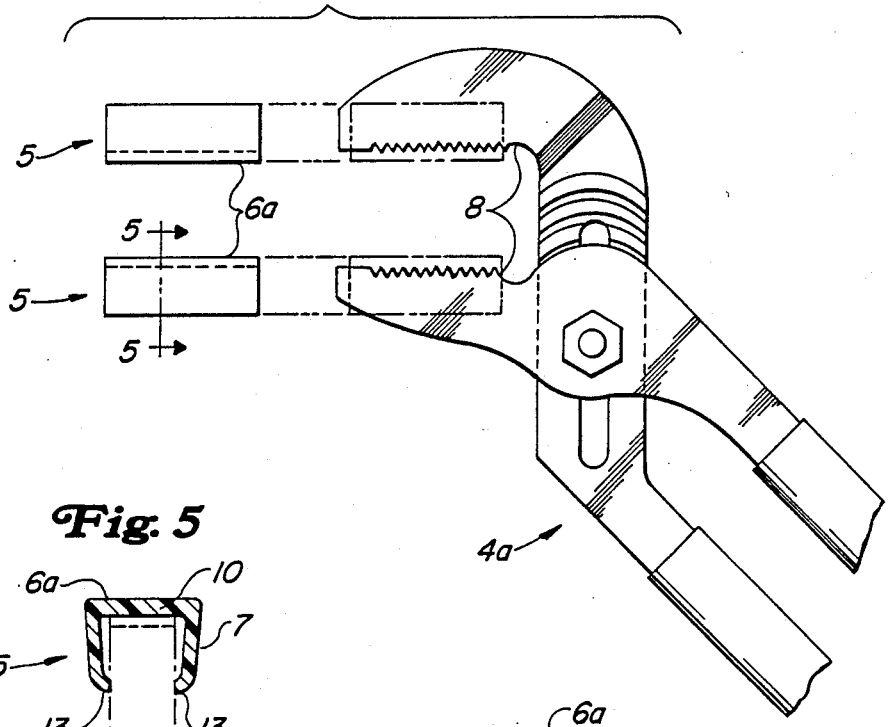
Fig. 5
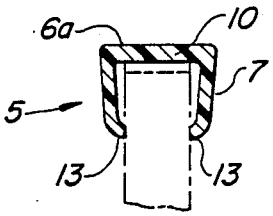
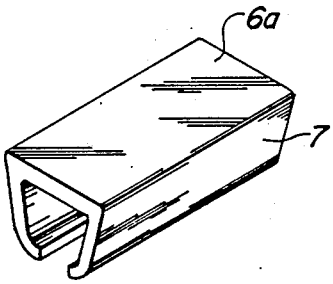
Fig. 6

ATTACHMENT FOR WRENCH JAWS

This is a continuation of application Ser. No. 07/152,520, filed February 5, 1988, now abandoned.

BACKGROUND OF THE INVENTION

The invention relates to attachments for gripping tools such as wrenches, pliers, and more particularly, to attachments which can be easily secured in the proper position on a gripping tool and also be easily removed from said gripping tool. The attachment will enable the wrench or pliers, etc., to firmly grip highly polished surfaces without causing damage thereto. Known attachments of this type have been made from rubber, plastics, etc., and have been formed of these materials with smooth surfaces as the gripping area. This invention provides serrated surfaces for gripping the smooth polished surface of the pipe or other article to be turned by the wrench. The prior art has not provided an attachment which may be securely fitted to a plurality of sizes of wrenches or pliers, etc., and also provide a serrated surface for gripping the article to be turned by the wrench.

SUMMARY AND OBJECTS OF THE INVENTION

It is an object of the present invention to provide attachments for wrench jaws which can be produced at much less cost than presently known attachments and which will fit a plurality of sizes of wrenches or pliers, etc. In addition, it is an object of this invention to provide suitable attachments for the gripping jaws of a wrench which will prevent the marring or deformation of the work surface on which said wrench is being used while providing gripping force comparable to the original jaws to rotate the object. It is a further object of this invention to provide such attachments for wrench jaws which will be firmly held in position by frictional engagement inherent in the attachment to securely hold it against the sides of the wrench jaws and provide resilient surfaces to improve the gripping relationship with the surface to be rotated by the wrench. The engaging surface may also be serrated for further improvement in the gripping relationship.

BRIEF DESCRIPTION OF THE DRAWING

FIG. 1 is a side view of a pipe wrench having the units or attachments shown both on and adjacent to the wrench surfaces. FIG. 2 is a cross-sectional view of the attachment taken through the line 2—2 of FIG. 1. FIG. 3 is a cross-sectional elevation view of the attachment in accordance with this invention. FIG. 4 is a side view of a channel grip wrench having another embodiment of the attachment shown both on and adjacent the wrench. FIG. 5 is a cross-sectional view of an attachment taken through 5—5. FIG. 6 is a cross-sectional view of the attachment of FIG. 4.

DETAILED DESCRIPTION OF THE INVENTION

Referring to the drawings, and in particular to FIG. 1, improved resilient attachments or coverings for the wrench jaw of the pipe wrench (4) are shown as elements (5). These elements in FIG. 1 are shown positioned covering the work engaging faces of the jaws (8) and positioned adjacent to these jaws (8) for application to the jaws in a manner to be described.

With particular reference now to the construction of the resilient attachments for wrench jaws (5), they are shown as being of one piece construction including a resilient base portion (10) that has the serrated working surface (6) cut into the base portion (10) as shown in FIG. 3, or a smooth surface as shown in FIG. 5. The attachment includes the flanged extensions or the arcuate extensions (7) that extend from the surface or from the base portion (1) at an acute angle. These extensions are of such a length and biased so that when not attached to the wrench jaw the ends of the flanged portion (7) will be substantially adjacent each other. Thus, the interior surface formed by the attachment is substantially triangular when not positioned on the jaws. Ends (13) of the attachment are capable of being separated against the tension of the attachment legs (7) and when placed upon the jaws (8) are held there by tensional and frictional engagement with the surfaces (13) against the side of the jaw (8). It is shown that the angles from the base portion (10) to the members (7) should be somewhat less than 90 degrees and that the unstressed angle is less than the stressed angle but will always remain acute. It is to be noted that by virtue of the arcuate configuration and the natural resiliency of the arms (7), the attachment (5) will be securely held in position on the wrench jaws (8). The attachment having been secured to the jaws in the manner described above, the additional feature of one embodiment of this attachment is that the engaging surface of the attachment is reproduced in a plastic material which will, with the serrations, deform sufficiently to prevent marring of the polished surfaces to which it is applied and yet have sufficient gripping force nearly that of the metal jaws to permit the tightening of the material to which the wrench is attached or gripped. Examples of plastic which are found to be highly effective are polypropylene, polyethylene and polyurethane materials which have an 80–95 durometer on the A scale. This durometer limitation provides adequate strength and stability for large gripping forces without marring. Prior art devices always stressed the material recovering rapidly to its original smooth shape after being indented. However, the prior art devices, because of this material characteristic did not have good frictional or stability characteristics. Also the prior art devices were not capable of being received over wrench or plier type jaws of varying sizes. The prior art devices seldom applied sufficient gripping force to the pipe or surface being gripped to adequately tighten without marring. While specific embodiments of the invention have been shown and described in detail to illustrate the application of the inventive principles, it will be understood that the invention may be embodied otherwise without departing from such principles.

I claim:

1. A removable attachment for tool jaws comprising: a resilient member having a base portion and a pair of spaced side portions extending from said base portion in triangular relationship; said side portions tapering inwardly at an acute angle from said base portion toward a focal point being essentially one apex of the triangular relationship having end portions remote from the base portion substantially adjacent each other in the unbiased state and extending generally parallel to said base portion; said base portion positionable against the face of a tool in abutting relation thereto; said side portions positionable on the tool jaw in a biased state with said end portions of each of the side portions biased to grip the sides of the tool jaw with the remaining segment of each of said side portions spaced away from the sides of said tool jaw.

2. The attachment for the wrench jaws of claim 1, further characterized in that said resilient base portion has a plurality of serrations on the gripping surface similar to the serrations of said wrench jaw.

3. The attachment for the wrench jaws of claim 1, further characterized in that said attachment is made from plastics in the 80–90 durometer range.

4. The attachment for the wrench jaws of claim 1, further characterized in that said wrench jaws attachment can be selectively applied to wrench jaws of varying configurations.

* * * * *